US005493258A

United States Patent [19]

Parker

[11] Patent Number: 5,493,258

[45] Date of Patent: Feb. 20, 1996

[54] DIELECTRIC RESONATOR DEMULTIPLEXER WITH MIC CIRCULATORS LOCATED WITHIN THE SUPPORT STRUCTURE

[75] Inventor: John R. Parker, Waterlooville, United Kingdom

[73] Assignee: Matra Marconi Space UK Limited, Stanmore, United Kingdom

[21] Appl. No.: 302,037

[22] Filed: Sep. 9, 1994

[51] Int. Cl.[6] ..... H01P 1/213

[52] U.S. Cl. ..... 333/134; 333/212

[58] Field of Search ..... 333/202, 212, 333/227–235, 126, 129, 134, 135, 28 R, 219.1

[56] References Cited

U.S. PATENT DOCUMENTS

| | | | |
|---|---|---|---|
| 3,865,990 | 2/1975 | Kuenemund | 333/28 R |
| 4,241,322 | 12/1980 | Johnson et al. | 333/202 |
| 4,920,323 | 4/1990 | Schloemann et al. | 333/1.1 |
| 5,008,640 | 4/1991 | Accatino et al. | 333/219.1 |
| 5,027,090 | 6/1991 | Gueble et al. | 333/202 |

FOREIGN PATENT DOCUMENTS

| | | |
|---|---|---|
| 0064799 | 11/1982 | European Pat. Off. . |
| 54-020638 | 2/1979 | Japan . |
| 62-183604 | 8/1987 | Japan . |
| 1590339 | 5/1981 | United Kingdom . |
| 1596558 | 8/1981 | United Kingdom . |
| 8704013 | 7/1987 | WIPO . |

OTHER PUBLICATIONS

1985 IEEE–MTT–S International Microwave Symposium Digest, Jun. 4–6, 1985; "Dielectric Resonator Output Multiplexer For C–Band Satellite Applications", W. C. Tang et al., pp. 343–344.

5th European Microwave Conference–proceedings, Sep. 1–4, 1975; "A Waveguide Multiplexer With Dual–Mode Filters For Satellite Use", G. Pfitzenmaier, pp. 407–411.

Microwave Journal, vol. 32, No. 12, Dec., 1989; "Satellite Multiplexing Using Dielectric Resonator Filters", D. Doust et al., pp. 93–106.

*Primary Examiner*—Benny Lee
*Assistant Examiner*—Justin P. Bettendorf
*Attorney, Agent, or Firm*—Spencer & Frank

[57] ABSTRACT

A dielectric resonator demultiplexer including at least one dielectric resonator filter including a plurality of cascaded dielectric resonators; and a support member on a surface of which the said at least one filter is vertically mounted with the longitudinal axis thereof substantially vertical to the mounting surface.

25 Claims, 5 Drawing Sheets

FIG. 2A
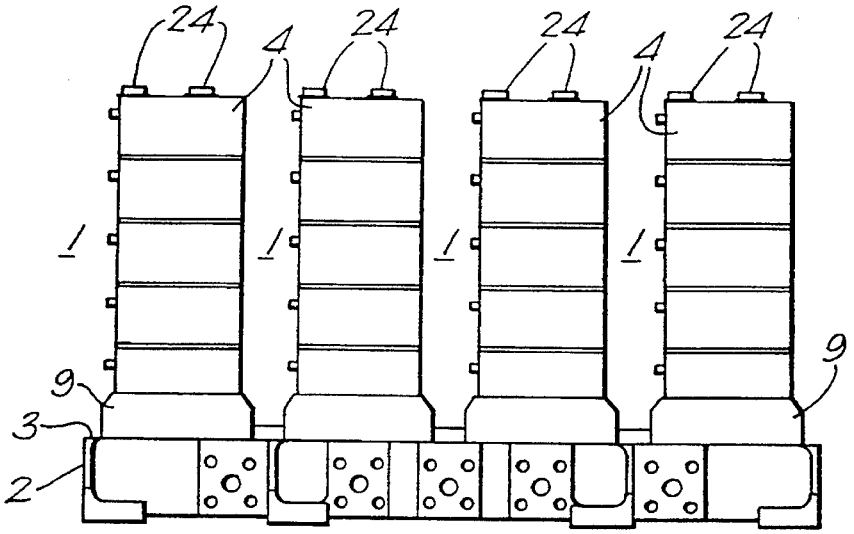
FIG. 2B
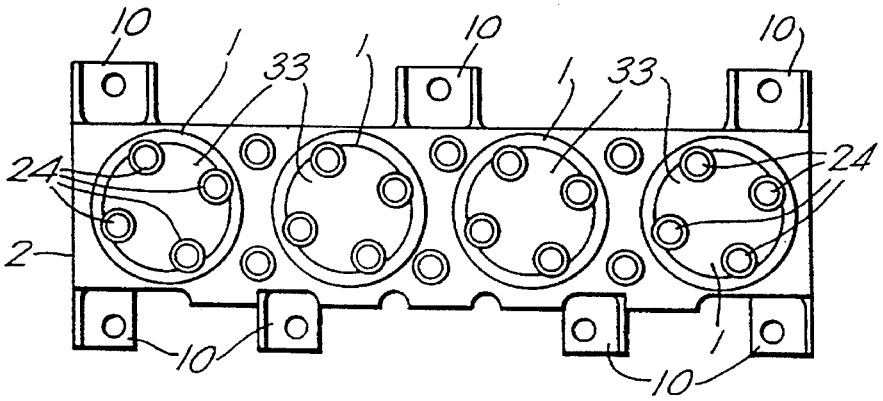
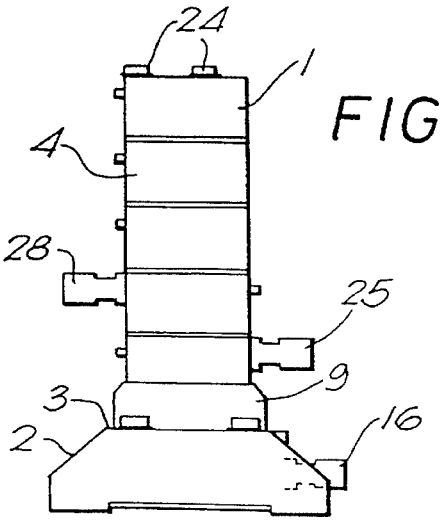
FIG. 2C

DIELECTRIC RESONATOR DEMULTIPLEXER WITH MIC CIRCULATORS LOCATED WITHIN THE SUPPORT STRUCTURE

BACKGROUND OF THE INVENTION

The invention relates to a dielectric resonator demultiplexer having a particular, but not necessarily an exclusive, application for communications satellite payloads.

Satellite communication systems are used for a number of different purposes, for example, ground surveillance, and telecommunications. The cost of placing communications satellite payloads into orbit is very high and it is desirable to have compact, reliable and light weight resonator filter structures that are sufficiently rugged and stable to withstand both the high levels of vibration experienced by space hardware during the launch phase of a mission and also long term effects of repeated thermal cycling experienced ever the duration of the mission. It is of importance to ensure in communication satellite payloads that a stable performance is maintained over a wide range of temperatures.

With known demultiplexer arrangements for communication satellite payloads, the resonant filters of the demultiplexer are mounted on the payload such that the longitudinal axes thereof are substantially parallel to the payload mounting surface.

With these arrangements, the area occupied by the demultiplexer, i.e. its "footprint", is fairly large and the mounting arrangement for the filters must be such that each of the resonator elements of the filters is not subject to undue mechanical and/or thermal stress.

The resonator cavity walls of the known arrangements are relatively thin and thereby susceptible to Induced mechanical/thermal stressing caused, in the main, by the mounting arrangements.

It is usual for the mounting arrangement to be in the form of a composite base plate i.e. a carbon fiber base plate, which is relatively light, but extremely expensive. The composite base plate has a low coefficient of thermal expansion and thereby minimizes thermal stressing of the filters.

In order to minimize the transmission of mechanical stresses from the composite base plate to the filter, it is necessary to interpose shims, i.e. extremely thin washers, at each of the points where the base plate is mounted on the payload mounting surface. The correct shimming arrangement is difficult to achieve but, once in place, is effective to reduce mechanical stresses.

SUMMARY OF THE INVENTION

It is an object of the present invention to overcome the foregoing problems by providing a dielectric resonator demultiplexer having a compact, rugged and stable structure that facilitates vertical mounting of the dielectric resonator filters and thereby minimizes the "footprint" i.e. the space occupied by the demultiplexer. The overall volume of the multiplexer is also minimized.

The invention provides a dielectric resonator demultiplexer including at least one dielectric resonator filter including a plurality of cascaded dielectric resonators, each one of which having a cavity therein; and a support member on a surface of which the said at least one filter is vertically mounted with the longitudinal axis thereof substantially vertical to the mounting surface.

It is usual for the dielectric resonator demultiplexer according to the present invention to include a plurality of vertically mounted dielectric resonator filters, for example, four filters located side-by-side on the support member.

In a preferred arrangement of the demultiplexer according to the present invention, each of the dielectric resonator filters includes five cascaded dielectric resonators. With one embodiment of this arrangement, internal microwave energy coupling means are interposed between adjacent dielectric resonators. With another embodiment of this arrangement, each of the dielectric resonator filters includes isolation means for preventing internal microwave energy coupling between that one of the five dielectric resonators, which is located at the free end of the filter and the adjacent filter, internal microwave energy coupling means interposed between adjacent ones of the other four dielectric resonators, and external equalization coupling means connected between the said one of the dielectric resonators and the microwave energy output of the said other four dielectric resonators. The dielectric resonator of each of the filters located adjacent to the support member is secured to the support member by an end cap interposed between the filter and the mounting surface of the support member.

The channel dropping circulator assembly for the, or each, dielectric resonator filter can be in the form of either a miniature coaxial circulator assembly, or a planar MIC compatible circulator assembly. In a preferred arrangement, an MIC compatible circulator assembly is used, and housed within the support member.

The structure of the dielectric resonator filters having five cascaded dielectric resonators includes eight titanium bolts for rigidly securing the resonators to each other, with microwave coupling means interposed between adjacent resonators.

The central resonator of the structure is provided with eight equi-spaced screw-threaded holes and the pairs of resonators on each side of the central resonator are each secured to the central resonator by four of the bolts which are passed through respective ones of four equi-spaced holes in the pairs of resonators, the holes in one of the pairs of resonators being displaced by 45° relative to the holes in the other pair of resonators.

BRIEF DESCRIPTION OF THE DRAWINGS

The foregoing and other features according to the present invention will be better understood from the following description with reference to the accompanying drawings, in which:

FIGS. 2A to 2C illustrate the dielectric resonator demultiplexer of FIG. 1 of the drawings respectively in a front view, a plan view and a side view.

DETAILED DESCRIPTION OF THE INVENTION

Figure 1:
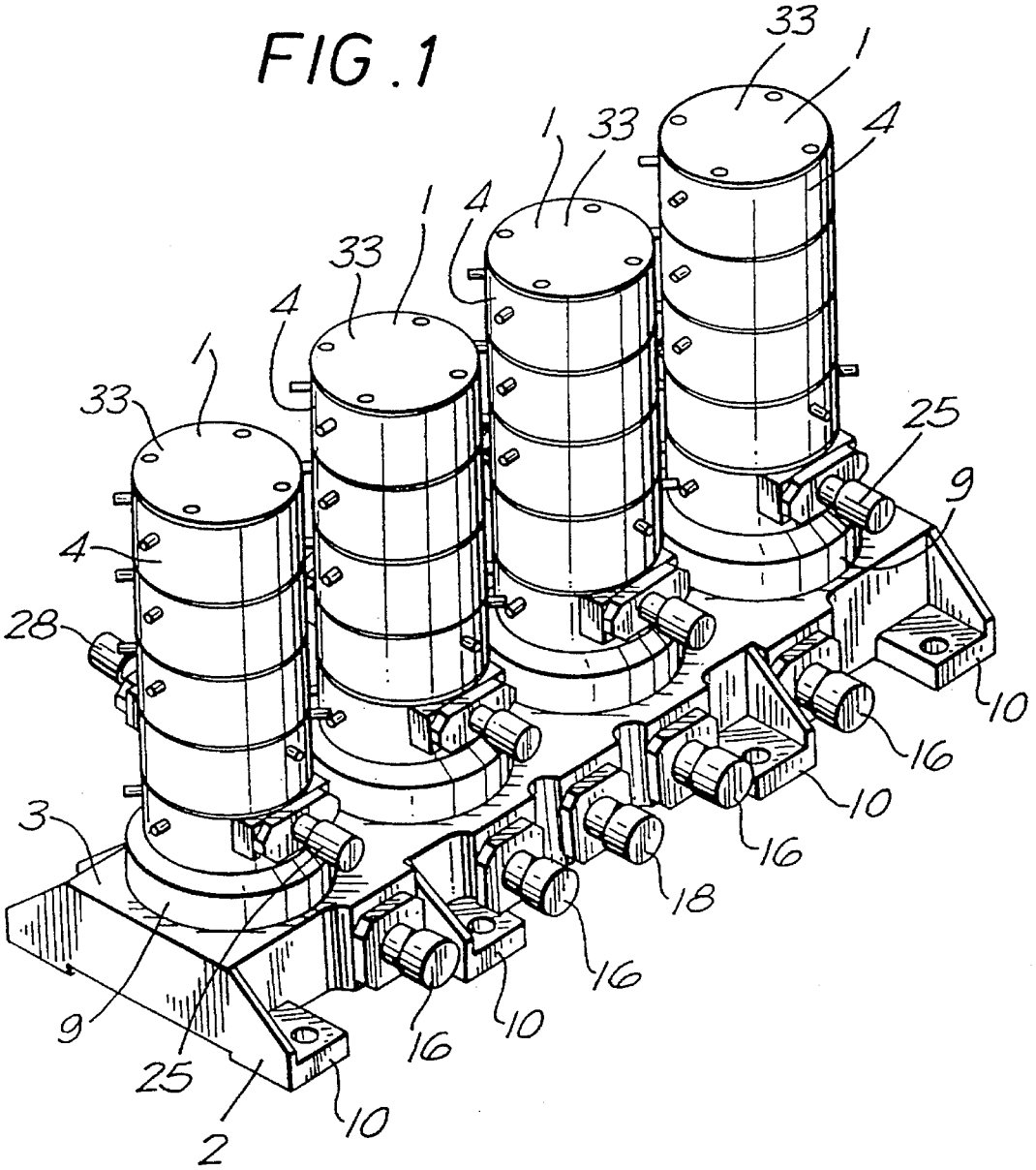
FIG. 1 illustrates, in a pictorial view, a dielectric resonator demultiplexer according to the present invention.

As illustrated in a pictorial view in FIG. 1 of the accompanying drawings, the dielectric resonator demultiplexer according to the present invention includes a plurality in the preferred arrangement four, dielectric resonator filters 1 and a support member 2 on a surface 3 of which the filters 1 are vertically mounted side-by-side with the longitudinal axis thereof substantially vertical to the surface 3.

Figure 4:
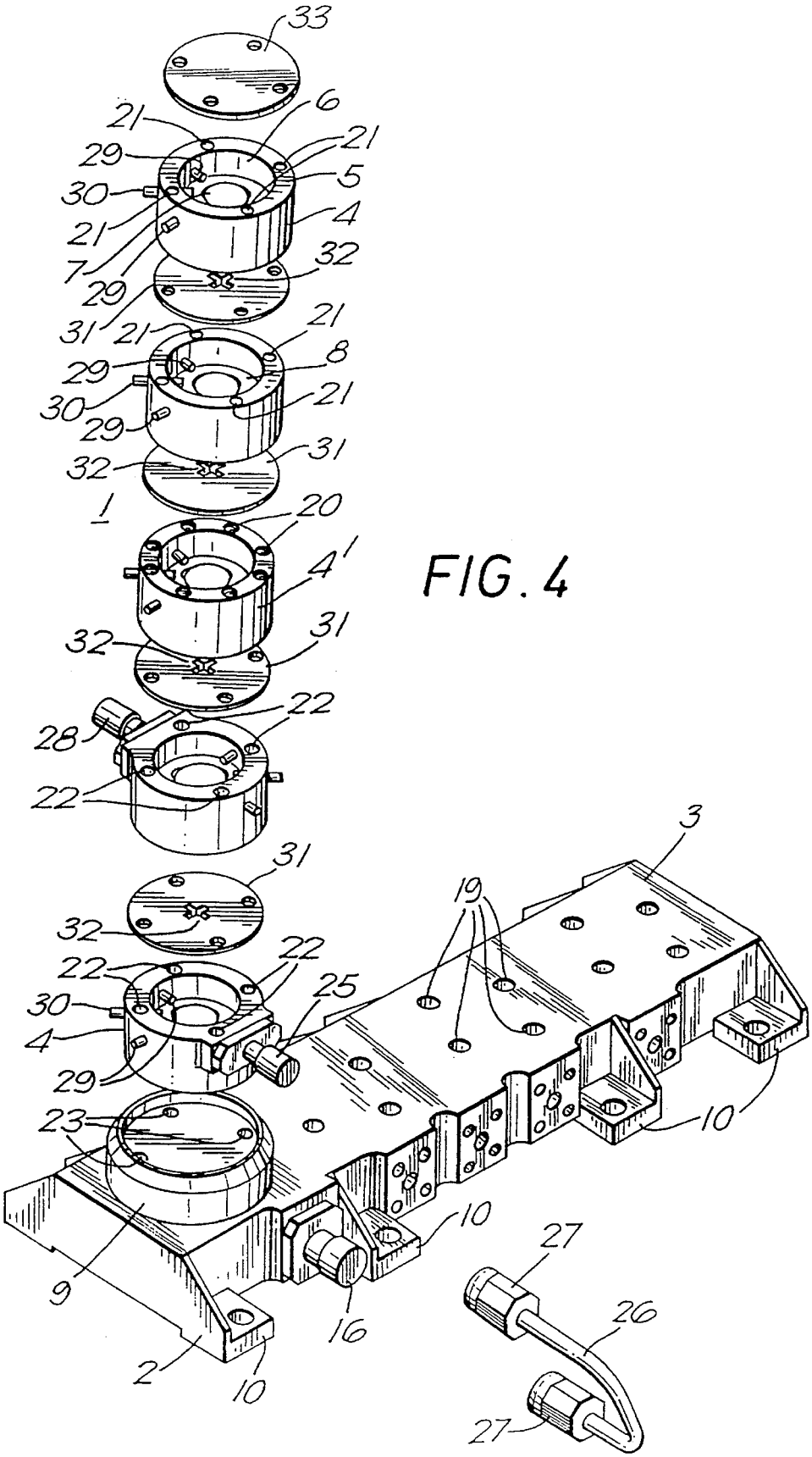
FIG. 4 illustrates, in an exploded pictorial view, part of the dielectric resonator demultiplexer of FIGS. 1 and 2 of the drawings.

The filters 1 are preferably provided by the dielectric resonator filters which are the subject of our co-pending patent application Ser. No. 9305073.0. Thus, each of the five cascaded dielectric resonator assemblies 4 of each of the filters 1 includes, as is best illustrated in FIG. 4 of the drawings, a housing member 5 having a cylindrical conductive cavity 6 symmetrically disposed about a longitudinal axis and an internally projecting flange (not illustrated). A cylindrical dielectric resonator element 7 is supported in a spacial central position within the cavity 6 by a ceramic support member 8. It will be seen from our above-mentioned co-pending application that the support member 8 has a coefficient of thermal expansion to match that of the resonator element 7 and is secured to the internally projecting flange of the housing member 5. The longitudinal axes of the cavity 6 and resonator element 7 are coaxial, and the equatorial planes of the resonator element 7, the conductive cavity and the support member 8 are all coincident.

The squat aspect ratio of the filters 1 facilitates the vertical mounting which minimizes the "footprint" of the demultiplexer, i.e. the space occupied by the demultiplexer on the mounting surface of the communications satellite payload, and the overall volume or the demultiplexer.

In addition to the foregoing, the demultiplexer according to the present invention eliminates the need tot special mounting brackets for the vertically orientated filters 1. As is best illustrated in FIG. 4 of the drawings, each of the filters 1 is provided with an end cap 9 having a recess therein into which the dielectric resonator assembly 4, situated immediately adjacent to the surface 3 of the support member 2, is fitted and secured in a manner to be subsequently outlined. The end cap 9 reduces the complexity and mass of the mounting arrangements for the filters 1, in comparison to the known demultiplexer arrangements referred to above. Furthermore, there is no need to provide, as with the known arrangements, a special composite base plate to match the coefficient of thermal expansion of the cavity housing material of the filters 1.

Figure 5A:
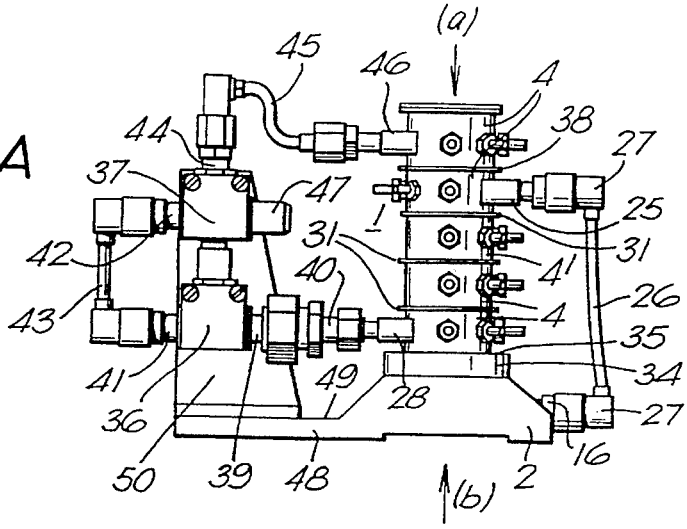
FIG. 5A to 5C illustrates an alternative arrangement for the dielectric resonator demultiplexer according to the present invention respectively in a side view, a plan view in the direction of arrow 'a' and a plan view in the direction of arrow 'b'.

In an alternative arrangement, the recessed end cap 9 for each of the filters 1 could be replaced by an end cap 34 which is best illustrated in FIG. 5A of the drawings and which has a planar surface 35 to which the dielectric resonator filters 1 are secured.

With the demultiplexer structure of FIG. 1, the transmission of mechanical stresses from the support member 2 to the filters 1 is minimized, and there is no need, as with known arrangements, for "shimming" in order to reduce mechanically induced stresses.

Figure 3A:
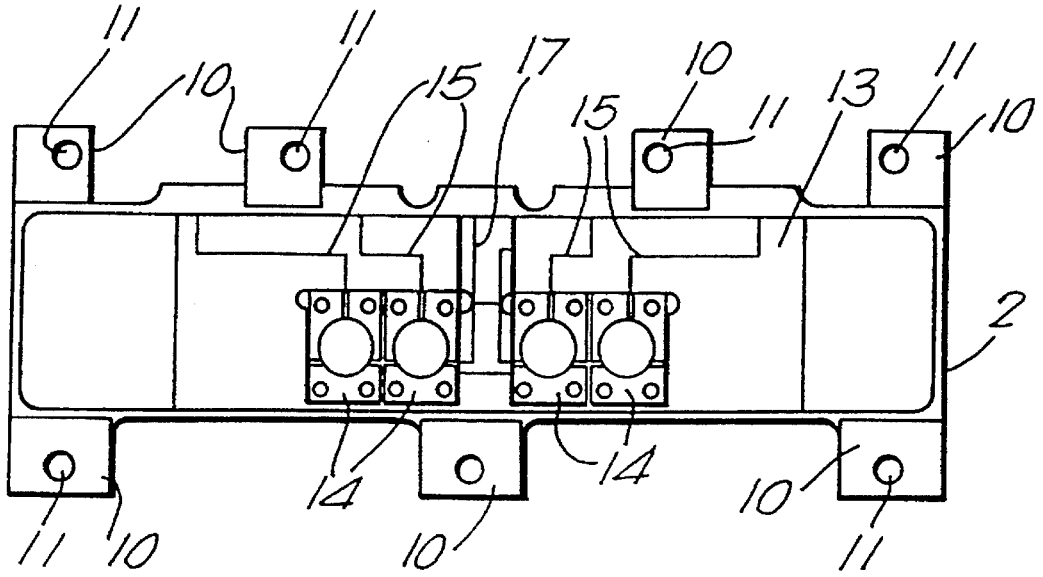
FIGS. 3A and 3B illustrate, in plan views, the underside of the support member of the dielectric demultiplexer of FIGS. 1 and 2 of the drawings.
Figure 3B:
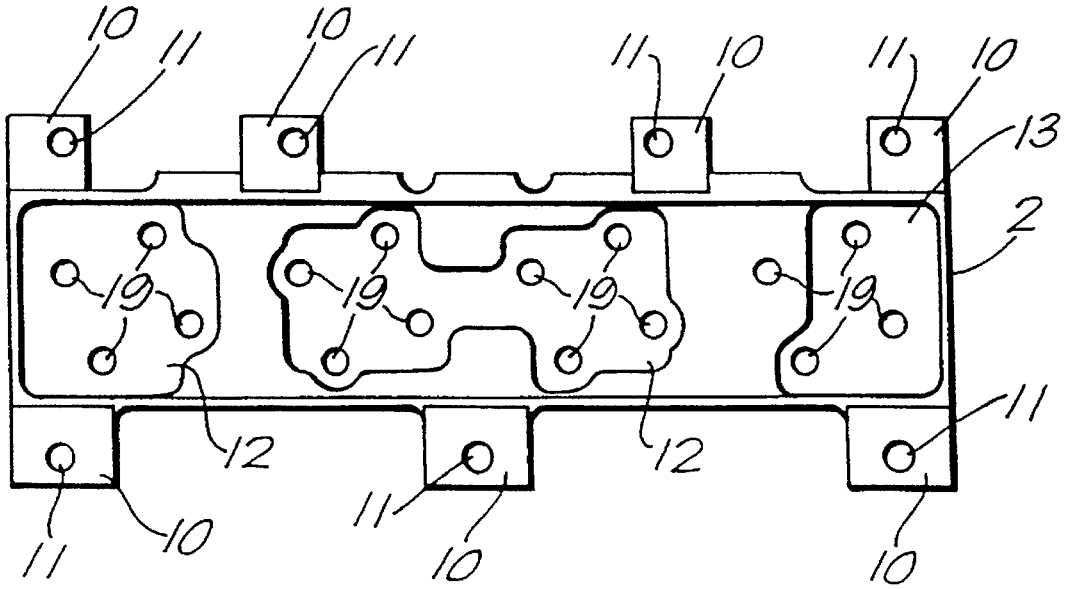

As is illustrated in FIGS. 3A and 3B of the accompanying drawings, which are plan views of the underside of the support member 2, the support member 2 is a dish-shaped structure having mounting flanges 10 with holes 11 therein for securing the demultiplexer onto the mounting surface of the satellite.

The three internal bosses 12 (see FIG. 3B) are used to support a substrate 13 mounted on a carrier (see FIG. 3A) on which is formed an assembly of four planar MIC compatible circulators 14, one for each of the filters 1.

The output connections 15 of the channel dropping circulator assemblies 14 are connected to respective ones of the four coaxial connectors 16 illustrated in FIG. 1 of the drawings.

The input 17 to the circulator assembly (see FIG. 3A) is connected to a coaxial connector 18 (see FIG. 1) to which the demultiplexer input is connected.

The holes 19 in the support member 2 provide the means for securing the filters 1 to the support member in a manner which will be subsequently outlined.

In an alternative arrangement, the channel dropping circulator assembly for each dielectric resonator filter 1 can be in the form of a miniature coaxial circulator assembly, In practice, a cover plate (not illustrated) would be used to enclose the space within the support member 2.

As is best illustrated in FIG. 4 of the drawings, the housing member 5 of the central resonator assembly 4' of each of the filters 1 has eight equi-spaced screw-threaded holes 20 formed therein for facilitating the securing of the other four dielectric resonator assemblies 4 to the central resonator assembly 4' and to the support member 2. Each of the two resonator assemblies 4 on one side of resonator assembly 4' have four equi-spaced through holes 21 formed therein, and each of the two resonator assemblies 4 on the other side of the resonator assembly 4' have four equi-spaced through holes 22 formed therein which are displaced by 45° relative to the four holes 21.

The four equi-spaced holes 23 in the end cap 9 match the four holes 22 in the resonator assemblies 4, and the respective four of the holes 19 in the support member 2.

The assembly of the structure utilizing the holes 19, 20, 21, 22 and 23, involves passing four extension bolts through respective ones of the holes 19, 23 and 22 which are then screwed into respective ones of four of the screw-threaded holes 20 thereby securing the bottom three resonator assemblies 4 to the end cap 9 and thereby to support member 2. A further four extension bolts are passed through respective ones of the holes 21 and are secured into respective ones of the other four of the screw-threaded holes 20 thereby securing the top two resonator assemblies 4 to the central resonator assembly 4' and thereby to the support member 2. The resulting structure is easy to assembly and is, mechanically, very rigid. In a preferred arrangement, the eight bolts are made of titanium to provide maximum strength and stability.

The heads 24 of four of the bolts are illustrated in FIGS. 2A to 2C of the drawings.

As illustrated in FIGS. 1 and 4 of the drawings, the resonator assembly 4 of each of the filters 1 which is secured to the end cap 9 includes input coupling means 25 for coupling the output of the respective one of the circulator assemblies 14 into the respective filter. The coupling is effected, as is best illustrated in FIG. 4 of the drawings, by means of a flexible coaxial cable 26, on each end of which is a coaxial connector 27. The connectors 27 are each connected to a separate one of the connectors 25 and 16.

The dielectric resonator assembly 4, adjacent to the resonator assembly 4 with the input coupling means 25, includes output coupling means 28 for coupling microwave energy transmitted by the filter to an external source. In practice, signal isolation means would be interposed between the output coupling means 28 and the external source to prevent the microwave energy generated by the filter 1 being reflected back to the filter via the output coupling means 28. Any known type of signal isolation means can be used for this purpose.

The input and output coupling means 25 and 28 include a coaxial connector and a capacitive probe connected at one end thereof to the central conductor of the coaxial connector, the other end of the probe extending into the cavity of the resonator assembly 4. The capacitive probe is electrically isolated from the housing member 5.

Figure 5B:
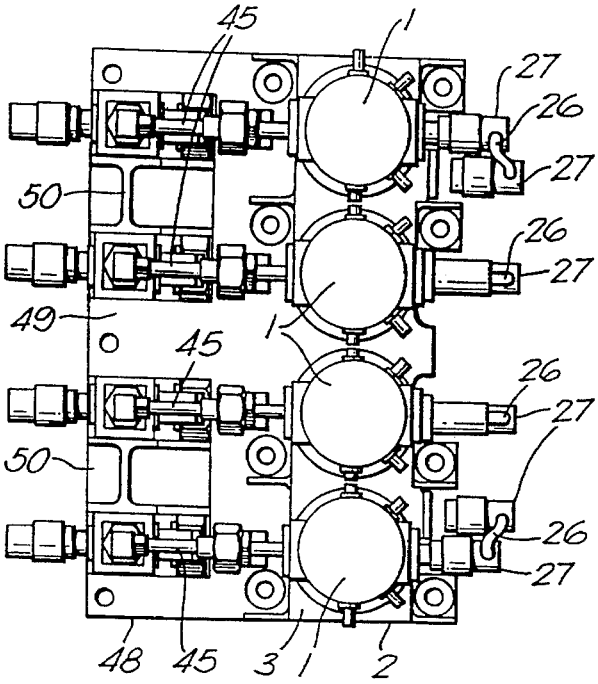

As is best diagrammatically illustrated in FIG. 4 of the drawings, each of the resonator assemblies 4 includes two tuning screws 29 and a coupling screw 30. Although, as illustrated in FIGS. 5A and 5B of the drawings, additional tuning screws could be provided for each of the resonator assemblies 4.

The tuning screws 29 each extend into the cavity 6 of the respective resonator assembly 4 on a radial plane coincident with a respective one of the two orthogonal dual mode electrical field orientations of the filter.

The coupling screw 30 extends into the cavity 6 of the respective resonator assembly 4 on a radial plane that is at 45° to the radial plane of the tuning screws 29.

In practice, the screw-threaded holes provided in the housing member 5 of the respective resonator assembly for the coupling and tuning screws, enable the position of the screws to be adjusted, i.e. the extent to which the screws 29 and 30 extend into the cavity is adjustable.

As is best illustrated in FIG. 4 of the drawings, each of the filters 1 include microwave energy coupling means 31 interposed between adjacent dielectric resonator assemblies 4. The coupling means 31 are preferably in the form of a planar member having an iris 32 formed therein which is cruciform in shape. Each of the coupling means 31 have four equi-spaced holes to match those of the resonator assemblies 4 and to thereby facilitate securing by means of the through bolts referred to above.

Each of the filters 1 is provided with an end cap 33 having four equi-spaced holes formed therein for facilitating securing by means of the through bolts referred to above.

Figure 5C:
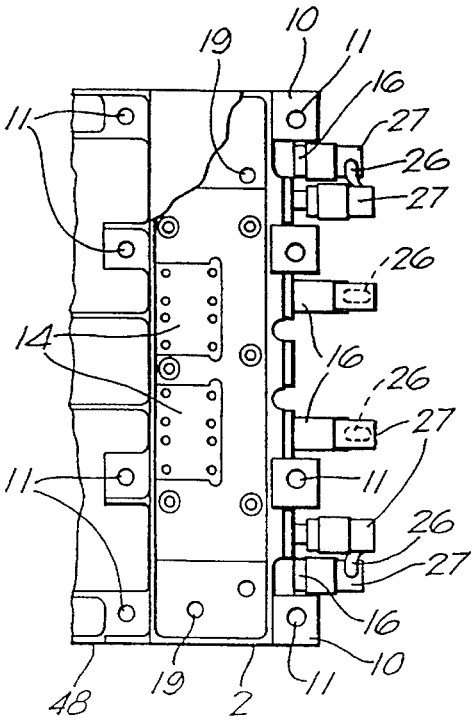

In an alternative arrangement for the dielectric resonator demultiplexer according to the present invention which is illustrated in FIGS. 5A to 5C of the drawings respectively in a side view, a plan view in the direction of arrow 'a' and a plan view in the direction of arrow 'b', each of the filters 1 includes an external equalization coupling arrangement comprising a signal isolator 36 and a circulator 37.

With the arrangement of FIGS. 5A to 5C, a solid disc 38 is interposed between the top two dielectric resonator assemblies 4 to prevent the coupling of microwave energy therebetween. The dielectric resonator assembly 4 interposed between the disc 38 and the dielectric resonator assembly 4' includes the input coupling means 25 and the dielectric resonator assembly 4 which is secured to the end support 34 includes the output coupling means 28. The input coupling means 25 of each of the filters 1 are, as is best illustrated in FIG. 5A of the drawings, connected to respective ones of the coaxial connectors 16 by a flexible coaxial cable assembly including a flexible coaxial cable 26 having a connector 27 at each end thereof.

The top dielectric resonator assembly 4, i.e. the assembly located at the free end of the filter 1, which is isolated from the other dielectric resonator assemblies 4, by the disc 38, includes coaxial coupling means 46.

The signal isolator 36 which is adapted to prevent the microwave energy generated by the filter 1 being reflected back to the filter via the output coupling means 28, includes an input port 39, connected to the output coupling means 28 by means of a coaxial cable assembly 40, and an output port 41 which is connected to one port 42 of the three part circulator 37 by means of a flexible coaxial cable assembly 43. Another port 44 of the circulator 37 is connected to the coupling means 46 by means of a coaxial cable assembly 45. The third port 47 of the circulator 37 is the output port for the filter, i.e. for coupling the microwave energy transmitted by the filter to an external source.

A longitudinal side edge of the support member 2 is, as is best illustrated in FIGS. 5A and 5B of the drawings, extended to provide a flange member 48 on the surface 49 of which the signal isolator 36 and circulator 37 of each of the filters 1 are securely mounted by means of bracket members 50, one for each pair of filters 1. If required, the isolator 36 and circulator 87 for each of the filters 1 could be secured to the surface 49 of the flange member 48 by means of separate bracket members, The manner in which the dielectric resonator elements 4 of each of the filters 1 are secured together and to the support member 2 is exactly the same as is outlined for the dielectric resonator demultiplexer of FIGS. 1 to 4 of the drawings.

It will be seen from FIG. 5C that the flange member 48 is also provided with holes 11 for securing the demultiplexer to the mounting surface of the satellite, In operation, the microwave energy transmitted by the cascaded dielectric resonator elements 4 situated between the input coupling means 25 and the output coupling means 28 of each of the filters 1 is fed via the output coupling means 28, coaxial cable assembly 40, isolator 36 and coaxial cable assembly 43 to the input port. 42 of the circulator 37, the reflection of microwave energy back to the filter 1 being prevented by the isolator 36. The circulator 37 is adapted to ensure that the microwave energy applied to its input port 42 is fed to the port 44 thereof, but not to the port 47, and thereby to the coupling means 46 via the coaxial cable assembly 45, as an input to the top dielectric resonator element 4. The resulting microwave energy transmitted by the top dielectric resonator element 4 is reflected back to the port 44 of the circulator 37 via the coupling means 46 and coaxial cable assembly 45. The circulator 37 is adapted to ensure that the reflected microwave energy at the port 44 is directed to the output coupling means 47 of the circulator 37 and not to the port 42 thereof.

It will be directly evident from the foregoing that the external equalisation coupling arrangement provides the means for affecting the cascaded coupling between the dielectric resonator element 4 which is secured to the end cap 34 and the top dielectric resonator assembly 4 of the or each filter 1.

The signal isolator 36 and the three port circulator 37 can each be of any known type of device that exhibits the necessary operational characteristics, As previously stated, the main application of the dielectric resonator demultiplexer outlined above is in a communications satellite payload.

I claim:

1. A dielectric resonator demultiplexer, including:

a plurality of dielectric resonator filters each including an input, and each including a plurality of cascaded dielectric resonators each having a cavity therein;

a support member having a mounting surface and a plurality of coaxial output connectors, each of said filters being perpendicularly mounted on the mounting surface with a respective longitudinal axis of said filters being substantially perpendicular to the mounting surface;

a plurality of channel dropping circulators, each comprising a planar MIC compatible circulator housed within said support member and operatively connected to a respective coaxial output connector; and a plurality of flexible coaxial cables, each connected to a respective filter input and to a respective coaxial output connector, so that each channel dropping circulator is in communication with a respective filter.

2. A dielectric resonator demultiplexer as claimed in claim 1, wherein said plurality of dielectric resonator filters comprise four dielectric resonator filters located side-by-side and vertically mounted on the mounting surface of the support member.

3. A dielectric resonator demultiplexer as claimed in claim 1, wherein each dielectric resonator filter includes five cascaded dielectric resonators.

4. A dielectric resonator demultiplexer as claimed in claim 3, wherein internal microwave energy coupling means are interposed between adjacent dielectric resonators of each dielectric resonator filter.

5. A dielectric resonator demultiplexer as claimed in claim 4, wherein one of the five cascaded dielectric resonators of each dielectric resonator filter is located adjacent to the mounting surface of the support member and includes the input of said filter for coupling external microwave energy from a respective channel dropping circulator into the cavity of the resonator, and wherein the dielectric resonator, located adjacent to said one of the cascaded dielectric resonators, includes output coupling means for coupling microwave energy transmitted by the filter to an external source.

6. A dielectric resonator demultiplexer as claimed in claim 4, wherein the internal microwave energy coupling means interposed between adjacent dielectric resonators include a planar member having an iris formed therein.

7. A dielectric resonator demultiplexer as claimed in claim 6, wherein the iris is cruciform in shape.

8. A dielectric resonator demultiplexer as claimed in claim 4, where each dielectric resonator filter includes:

isolation means for preventing internal microwave energy coupling between one of the five cascaded dielectric resonators, which is located at the free end of the dielectric resonator filter, and the dielectric resonator located adjacent thereto;

internal microwave energy coupling means interposed between adjacent ones of the other four dielectric resonators;

microwave energy output means for the other four dielectric resonators; and external equalization coupling means connected between the one of the cascaded dielectric resonators located at the free end of the dielectric resonator filter and the microwave energy output means of the other four dielectric resonators.

9. A dielectric resonator demultiplexer as claimed in claim 8, wherein the external equalization coupling means for each filter includes:

a signal isolator, an input of which is connected to the microwave energy output means of the other four dielectric resonator; and a three port circulator, one port of which is connected to an output of the signal isolator, a second port of which is connected to the one of the dielectric resonators, and a third port of which is an output of the filter, wherein the signal isolator is adapted to prevent the microwave energy transmitted by the other four dielectric resonators from being reflected back to the filter, and wherein the three port circulator is adapted to cause the microwave energy transmitted to the one port thereof to be coupled to the second port but not to the third port, and to cause the microwave energy reflected back to the second port from the one of the dielectric resonators to be coupled to the third port but not to the one port.

10. A dielectric resonator demultiplexer as claimed in claim 8, wherein said microwave energy output means comprises first coaxial coupling means connected to one of the other four dielectric resonators located adjacent to the mounting surface of the support member, wherein the one of the dielectric resonators located at the free end of the filter includes second coaxial coupling means, wherein one of the other four dielectric resonators located adjacent to the isolation means includes the input of said filter or coupling external microwave energy from a respective channel dropping circulator to the filter, and wherein the external equalization coupling means are connected between the first and second coaxial coupling means.

11. A dielectric resonator demultiplexer as claimed in claim 8, wherein the isolation means for each filter comprises a planar disc interposed between the said one of the dielectric resonators and the adjacent dielectric resonator.

12. A dielectric resonator demultiplexer as claimed in claim 11, wherein the external equalization coupling means for each filter includes a signal isolator, the input of which is connected to the microwave energy output means of the other four dielectric resonators, and a three port circulator, one port of which is connected to the output of the signal isolator, a second port of which is connected to the one of the dielectric resonators and the third port of which is the output of the filter, wherein the signal isolator is adapted to prevent the microwave energy transmitted by the other four dielectric resonators being reflected back to the filter, and wherein the circulator is adapted to cause the microwave energy applied to the one port thereof to be coupled to the second port but not to the third port and to cause the microwave energy reflected back to the second port from the said one of the dielectric resonators to be coupled to the third port but not to the one port.

13. A dielectric resonator demultiplexer as claimed in claim 1, wherein each dielectric resonator filter includes an end cap for vertically mounting the filter on the support member.

14. A dielectric resonator demultiplexer as claimed in claim 13, wherein the end cap includes a recess in which the filter is located.

15. A dielectric resonator demultiplexer as claimed in claim 13, wherein the end cap has a planar surface on which the filter is located.

16. A dielectric resonator demultiplexer as claimed in claim 1, wherein each of the cascaded dielectric resonators includes at least two tuning screws, each one of which extends into the cavity of the resonator on a radial plane coincident with a respective one of the two orthogonal dual mode electrical field orientations of the filter, and a coupling screw that extends into the cavity of the resonator on a radial plane that is at 45° to the radial plane of the tuning screws, the extent to which the tuning and coupling screws extend into the cavity being adjustable.

17. A dielectric resonator demultiplexer as claimed in claim 1, wherein each of the cascaded dielectric resonators includes a housing member having a cylindrical conductive cavity symmetrically disposed about the longitudinal axis; a cylindrical dielectric resonator element; and a dielectric support member for the resonator element, the support member having a coefficient of thermal expansion to match that of the resonator element, and being adapted to support the resonator element, at the peripheral surface thereof, in a spacial central position within the cavity, whereby the longitudinal axes of the cavity and the resonator element are coaxial and substantially perpendicular with respect to the mounting surface of the support member.

18. A dielectric resonator demultiplexer as claimed in claim 17, wherein the housing member of each of the cascaded dielectric resonators includes at least four fixing holes for facilitating the mounting of the cascaded resonators in alignment.

19. A dielectric resonator demultiplexer as claimed in claim 18, wherein each dielectric resonator filter includes five cascaded dielectric resonators, wherein the central dielectric resonator of the five cascaded dielectric resonators includes eight equi-spaced screw-threaded holes for facilitating the securing of the cascaded dielectric resonators to each other by means of eight bolts, wherein each of the other four dielectric resonators includes four equi-spaced through holes adapted to receive the bolts, wherein four of the bolts are passed through respective ones of the four holes in one pair of the dielectric resonators on one side of the central dielectric resonator and into respective ones of four of the screw-threaded holes to secure the one pair of dielectric resonators to the central dielectric resonator, and wherein the four other bolts are passed through respective ones of the four holes, which are displaced by 45° relative to the four holes in the one pair of the dielectric resonators, in the other pair of the dielectric resonators on the other side of the central dielectric resonator and into respective ones of the other four of the screw-threaded holes to secure the other pair of dielectric resonators to the central resonator.

20. A dielectric resonator demultiplexer as claimed in claim 19, wherein the bolts are of titanium.

21. A dielectric resonator demultiplexer, including:

at least four dielectric resonator filters, each filter including:

at least five cascaded dielectric resonators each having a cavity therein;

isolation means for preventing internal microwave energy coupling between one of the five cascaded dielectric resonators, which is located at a free end of the dielectric resonator filter, and the dielectric resonator located adjacent thereto;

internal microwave energy coupling means interposed between adjacent ones of the other four dielectric resonators of each of said filters;

microwave energy output means for the other four dielectric resonators; and external equalization coupling means connected between the one of the cascaded dielectric resonators located at the free end of the dielectric resonator filter and the microwave energy output means of the other four dielectric resonators; and a support member having a mounting surface for said filters, said filters being located side-by-side and perpendicularly mounted on the mounting surface of the support member, the longitudinal axis of each of said filters being substantially perpendicular to the mounting surface;

wherein one of the other four dielectric resonators includes input coupling means for coupling external microwave energy from an external source into the cavity of the resonators, and wherein another of the other four dielectric resonators includes said microwave energy output means for coupling microwave energy transmitted by said filter to said external equalization coupling means.

22. A communications satellite payload including a dielectric resonator demultiplexer, said dielectric resonator demultiplexer including:

a plurality of dielectric resonator filters each including an input, and each including a plurality of cascaded dielectric resonators each having a cavity therein;

a support member having a mounting surface and a plurality of coaxial output connectors, each of said filters being perpendicularly mounted on the mounting surface with a respective longitudinal axis of said filters being substantially perpendicular to the mounting surface;

a plurality of channel dropping circulators, each comprising a planar MIC compatible circulator housed within said support member and operatively connected to a respective coaxial output connector; and a plurality of flexible coaxial cables, each connected to a respective filter input and to a respective coaxial output connector, so that each channel dropping circulator is in communication with a respective filter.

23. A dielectric resonator demultiplexer, including:

a plurality of dielectric resonator filters, each having at least three cascaded dielectric resonators, each dielectric resonator comprising:

a housing member having a cylindrical conductive cavity symmetrically disposed about a longitudinal axis of said filter;

a cylindrical dielectric resonator element; and a dielectric support member for supporting said resonator element at a peripheral surface thereof in a spacial central position within the cavity, the cavity and said resonator element each having a coaxial longitudinal axis substantially perpendicular to the mounting surface of said support member, said support member having a coefficient of thermal expansion matching that of said resonator element;

wherein a central dielectric resonator includes a plurality of equi-spaced screw-threaded holes on a first side thereof, and a plurality of equi-spaced screw-threaded holes on a second side thereof;

wherein said housing of the other dielectric support members includes a plurality of through holes in registration with the screw-threaded holes for accommodating respective bolts for fixedly mounting said cascaded dielectric elements in alignment to said central dielectric resonator so that the through holes of the dielectric support member attached to the first side of the central dielectric support member are displaced by 45° relative to the through holes of the dielectric support member attached to the second side of the central dielectric support member; and a support member having a mounting surface, said plurality of filters being mounted on the mounting surface with the longitudinal axis of each said filter being substantially perpendicular to the mounting surface.

24. A dielectric resonator demultiplexer as claimed in claim 23, wherein said central dielectric resonator includes four equi-spaced screw-threaded holes on the first side thereof, and a four equi-spaced screw-threaded holes on a second side thereof; and wherein said housing of the other dielectric support members includes four through holes.

25. A dielectric resonator demultiplexer as claimed in claim 23, wherein each said dielectric resonator filter has at least five cascaded dielectric resonators.

* * * * *